United States Patent [19]

Bay

[11] 3,976,438

[45] Aug. 24, 1976

[54] GASOLINE ADDITIVE AND METHOD FOR MAKING SAME

[75] Inventor: Eugene H. Bay, Jersey Shore, Pa.

[73] Assignee: Clifton McCleary, Jr., Washington, D.C.

[22] Filed: Sept. 12, 1975

[21] Appl. No.: 612,990

[52] U.S. Cl. ..... 44/61; 44/50; 208/8

[51] Int. Cl.[2] ..... C10L 1/26

[58] Field of Search ..... 208/8; 44/6, 56, 66, 44/61

[56] References Cited

UNITED STATES PATENTS

| | | | |
|---|---|---|---|
| 23,167 | 3/1859 | Griffin | 44/61 |
| 1,557,257 | 10/1925 | La Riboisiere | 44/56 |
| 1,823,594 | 9/1931 | Diggs | 44/61 |
| 3,117,921 | 1/1964 | Gorin | 208/8 |
| 3,143,489 | 8/1964 | Gorin | 208/8 |
| 3,849,287 | 11/1974 | Gleim et al. | 208/8 |

*Primary Examiner*—Daniel E. Wyman
*Assistant Examiner*—Y. Harris-Smith
*Attorney, Agent, or Firm*—Beveridge, DeGrandi, Kline & Lunsford

[57] ABSTRACT

A gasoline additive and method for making such additive wherein bituminous coal is successively immersed into a mixture of (1) mineral spirits and carbide, (2) a ketone and carbide, and (3) benzene and carbide, for a period of from about 10 to 30 hours in each mixture. The mixtures are then combined and to 100 parts by volume thereof are added, by volume, 60 parts methyl isobutyl ketone, 300 parts orthodichlorbenzene, 370 parts mineral spirits and 75 parts tri-o-cresyl phosphate. When this final mixture is added to gasoline in an amount of about one ounce per ten gallons of gasoline, automotive vehicles - operating on such gasoline have their mileage per gallon of gasoline improved up to about thirty to forty percent and more.

20 Claims, No Drawings

GASOLINE ADDITIVE AND METHOD FOR MAKING SAME

With the present petroleum shortage in the United States and certain other parts of the world and the resultant constant increase in the retail price of gasoline produced therefrom, any improvement on gasoline mileage which can be obtained with existing automotive vehicles, including automobiles, trucks, buses, etc., will be of tremendous economic benefit to the gasoline purchaser.

It has now been found that the addition of an additive to gasoline in an amount of about 0.1 ounce per gallon will increase the mileage normally obtained by an automobile in city and highway driving by from about thirty to forty percent or more.

To briefly describe the invention, clean, dry bituminous coal is immersed into a first mixture of mineral spirits, such as mineral spirits No. 10 and calcium carbide and kept therein for a period of about 10 to 30 hours. The coal is then removed and immersed into a second mixture of calcium carbide and a ketone, such as acetone, methyl isobutyl ketone, and the like, and is kept therein for a period of about 10 to 30 hours. At the end of this time, the coal is again removed and immersed into a third mixture of calcium carbide and benzene for a similar period of about 10 to 30 hours. Meanwhile, the second mixture, after removal of the coal, is added to the first mixture. After removal of the coal from the third mixture, the mixture is added to the combined first and second mixture and is uniformly dispersed therein. To about 100 parts by volume of this combined mixture is added, by volume, about 60 parts of a ketone, such as acetone, methyl isobutyl ketone, etc., about 300 parts orthodichlorbenzene, about 370 parts mineral spirits, such as No. 10, and about 75 parts tri-o-cresyl phosphate.

When about 0.1 ounce of this mixture is added to gasoline obtained at commercial filling or service stations, either leaded or unleaded and irrespective of its octane rating, and an automobile is operated on such gasoline for a period of time, there is a definite improvement in the mileage performance of the car of from about 30 to 40 percent and higher.

The invention will now be described in greater detail. Soft coal, also known as bituminous coal, is used for purposes of this invention. Coal consists chiefly of carbon, hydrogen, nitrogen, oxygen and other elements, such as silicon, phosphorus, arsenic, iron, etc. Bituminous coal is further classified as bituminous A, B, C and D and it has been found that all classes of bituminous coal are satisfactory in the process of this invention with bituminous A being preferred.

The coal is used in lumps ranging in size from about two ounces to about 5 pounds and lumps averaging about one quarter to one-half pounds apiece are preferred. If lumps over five pounds are used, the surface area of the coal is decreased and longer immersion times may be necessary in subsequent steps of the process. Powdered coal may be used in the process but it would only add to the expense of the process without materially improving the results. To subsequently remove such powdered coal from the various mixtures utilized in the process, additional equipment, such as sieves or strainers would have to be used.

The coal should first be cleaned and dried to remove all dirt therefrom and to insure that no water is subsequently introduced into the mixtures utilized in the process. Any known cleaning method can be used. However, it is preferred to clean the coal by first immersing it in a tank of water for about twenty-four hours, removing it therefrom and drying it for another period of about twenty-four hours, subjecting it to a hot air stream and periodically turning the coal so that all portions thereof are exposed to the stream. There is no criticality as to the times referred to above. All that is important is that the coal be clean and dry so that no impurities nor water are introduced into the process.

The following example is illustrative of the process of the invention but is not to be considered as limiting the scope of the invention in any way:

Into a tank containing 75 gallons of water is immersed 50 pounds of bituminous coal having a lump size not exceeding about one-quarter of a pound. After a period of twenty-four hours the coal is removed and air dried for twenty-four hours by passing a stream of hot air thereover.

The cleaned, dried, coal, being essentially free from moisture, was placed into a first tank containing 75 gallons of mineral spirits No. 10 into which one pound of calcium carbide had first been thoroughly mixed. After 24 hours, the coal was removed from the tank and was immersed into a second tank containing 75 gallons of acetone into which one pound of calcium carbide had been thoroughly admixed.

After 24 hours immersion in the mixture, the coal was removed and immersed into a third tank containing 75 gallons of benzene into which one pound of calcium carbide had been thoroughly admixed. The liquid mixture of the second tank was combined with the liquid mixture of the first tank.

After the coal had been immersed for 24 hours in the third tank it was removed, and the liquid mixture was added to the liquid mixtures of the first two tanks. To 100 gallons of the combined mixtures of the liquids of the three tanks are added 60 gallons of methyl isobutyl ketone, 300 gallons of orthodichlorbenzene, 370 gallons of mineral spirits No. 10 and 75 gallons of tri-ortho-cresyl phosphate and the ingredients are thoroughly mixed to form the additive of the invention. It has a reddish color and is very similar to gasoline in appearance.

The additive was added to gasoline and a number of cars were tested therewith in city and highway driving. In each instance, 0.15 ounces of additive were added to each gallon of gasoline up to the first twenty gallons used in driving the automobile. Thereafter 0.1 ounce was added to each gallon of gasoline used in test driving the vehicle. Use of more additive does not improve the mileage obtained. If less additive is used, the improvement in the mileage is less noticeable. Thus, 3 ounces of additive were first added to the gasoline tank of each automobile tested and then twenty gallons of gasoline were pumped into the tank, the entry of the gasoline causing agitation within the tank and assisting in the distribution of the additive throughout the gasoline. As additional gasoline was added to the vehicle fuel tank during the test, one ounce of additive was placed within the tank prior to the introduction of each 10 gallon increments of gasoline.

The following indicates the results obtained by the additive of the invention added to the gasoline in the amounts and in the manner discussed above.

1. A 1974 Ford Custom 500 automobile having a 460 CC engine and about 102,000 miles on the speedometer and equipped with airconditioning and radio were tested by driving it on fifty gallons of gasoline containing the additive of the invention. The car averaged 11 miles per gallon of gasoline prior to the test and 14.93 miles per gallon using gasoline containing the additive of the invention. This is an improvement of 35.7%.

2. A 1974 Chevrolet Bel Air equipped with a 351 CC engine, air-conditioning and radio and having about 65,000 miles on the speedometer averaged 13.53 miles per gallon prior to the test and 18.0 miles per gallon when driven with 50 gallons of gasoline containing the additive of the invention, an improvement of 33%.

3. A 1969 Oldsmobile Toronado equipped with a 455 CC engine, full power equipment and air-conditioning and having about 60,000 miles on the speedometer averaged 10 miles to the gallon in city driving and 11.5 miles per gallon on the highway prior to the test. Using 50 gallons of gasoline containing the additive of the invention, the car averaged 13.7 miles per gallon in city driving. Using another 50 gallons of gasoline plus additive, the car averaged 16.2 miles per gallon on the highway. The improvement was 37% for city driving and 40.9% for highway driving.

4. A 1975 Cadillac having a 455 CC engine, full power equipment and air-conditioning, with about 7,000 miles on the speedometer, averaged 11 miles per gallon in highway driving prior to the test. With gasoline containing the additive of the invention, the car averaged 15.2 miles per gallon. 110 gallons of gasoline containing the additive were used during the test. The improvement in mileage was 38.2%.

With respect to the tests involving each of the four cars identified above, the driving conditions prior and during the tests were about the same, i.e. air-conditioning was used, as was power steering, power brakes, radio, etc., so that a more accurate comparison could be made. Likewise, the gasoline used prior and during the tests was the same for each car except that the test gasoline contained the additive of the invention.

Although mineral spirits No. 10 was used in making the additive of the invention by the process described in the above example and this is a petroleum solvent having a boiling point of from 152.2° C. to 197,8° C., mineral spirits in general are suitable for the purpose of the invention. However, the higher the grade of the mineral spirits, the more volatile it is and the better the results obtained. Refined mineral spirits sold under the trademark "Salvesso", although more expensive, increase the effectiveness of the additive by about ten percent.

While calcium carbide has been specifically disclosed, since it is the carbide of commerce and is readily available, no reason is known why other carbides such as alkali metal carbides including lithium carbide, potassium carbide, etc., alkaline earth metal carbides such as barium carbide, strontium carbide, etc., aluminum carbide and the like and mixtures thereof should not work satisfactorily. Accordingly, whenever the term carbide is used in a generic sense in this application and in the appended claims, it is meant to include calcium carbide and the foregoing carbides.

While the ketone used in forming the second mixture described in the above process is dimethyl ketone, no reason is known why other dialkyl ketones will not work satisfactorily. Methyl isobutyl ketone can be used in lieu of the acetone and vice versa in this process. Dialkyls having up to eight, ten or even 12 or more carbon atoms could be used for this invention.

The role played by the bituminous coal in the process is not fully understood although other types of coal are not suitable for the purpose of this invention. If the mineral spirits, acetone, benzene and calcium carbide of the above example were simply mixed together and the clean, dry, bituminous coal was immersed therein from one to three days, a satisfactory additive can still be formed with the addition of the other ingredients thereto. However, the amount of end product is diminished drastically resulting in a vast increase in the cost of manufacture of the additive. By following the procedure described above in the example, the cost of producing the additive of the invention is kept to a minimum.

It is believed that the immersion of the coal in the mineral spirits mixture results in the removal of hydrogen from the coal, but it is not certain how the hydrogen reacts or combines with the mineral spirits and the carbide. It is further believed that the immersion of the coal in the ketone and carbide mixture results in the removal of oxygen from the coal. Likewise, the immersion of the coal in the benzene and carbide mixture results in the removal of carbon from the coal. If this theory is correct, then it may be possible to eliminate the use of bituminous coal altogether and merely introduce hydrogen into the mineral spirits - carbide mixture; introduce oxygen into the ketone - carbide mixture and introduce carbon into the benzene - carbide mixture. The amounts of hydrogen, oxygen, and carbon would necessarily be those amounts sufficient to make the separate mixtures equivalent to those obtained by the process described in the above example.

In another embodiment of the invention, a gasoline additive which will improve the mileage performance of automotive vehicles is prepared by slowly adding from about 45 to 75 parts by volume of methyl isobutyl ketone into from about 270 to about 330 parts by volume of orthodichlorbenzene while the latter is slowly stirred and the mixture is continuously stirred for a period of from about 10 to about 30 hours. The mixture is then slowly poured into about 185 to about 740 parts by volume of mineral spirits as the latter is slowly stirred and the resulting mixture is slowly stirred for a period of about 10 to about 30 hours. The resulting mixture is then slowly added to about 70 to about 130 parts of tri-ortho-cresyl phosphate as the latter is stirred, and the mixture is slowly stirred for a period of from about 10 to about 30 hours. The resulting mixture is then added to from about 70 parts to about 150 parts by volume of toluene or a dialkyl ketone wherein each alkyl has from 1 to about 12 carbon atoms, preferably from 1 to about 8 C atoms, such as acetone, and the like. The toluene or dialkyl ketone is also slowly rotated during the addition of the mixture thereto, and such rotation is also carried out for a period of from about 10 to about 30 hours. The preferred time for rotation of each of the above mixtures is about twenty-four hours since this insures that a stable colloid is formed, which colloid is the additive of this embodiment of the invention. Thus the time for rotation has to be the time sufficient to form a stable colloid of the mixture.

As an illustrative example of this embodiment of the invention, a colloid was prepared from the following ingredients:

| | | |
|---|---|---|
| (1) | methyl isobutyl ketone | 60 gallons |
| (2) | orthodichlorbenzene | 300 gallons |

-continued

| | | |
|---|---|---|
| (3) | mineral spirits No. 10 | 370 gallons |
| (4) | tri-o-cresyl phosphate | 75 gallons |
| (5) | toluene | 100 gallons. |

In preparing the colloid, ingredient (1) was addded to ingredient (2) while the latter was slowly stirred and the mixture was then stirred for 24 hours. The mixture was added to ingredient (3) while it was stirred and the resulting mixture was stirred for 24 hours. The resulting mixture was similarly added to ingredient (4) and stirring continued for 24 hours with this mixture then being added to ingredient (5) under similar stirring conditions for 24 hours. The final mixture was a colloid which was suitable as an additive for gasoline and which improved the mileage obtained by automotive vehicles operating on gasoline containing this additive. All of the addition of the ingredients and mixtures is done slowly during stirring, and all stirring is done slowly, so as to permit the stable colloid to be formed.

The additive is added in an amount of about 0.15 ounces per gallon for the first twenty gallons of gasoline used and then in an amount of from about 0.03 to about 0.07 ounces per gallon, and preferably about 0.05 ounces per gallon. 3 ounces of additive may be added to the gas tank of the vehicle and twenty gallons of gas are then pumped into the tank, resulting in a substantially uniform distribution of the additive throughout the tank. After the fuel is consumed during the operation of the vehicle, one-half ounce of additive may be added to the vehicle fuel tank for each ten gallons of gasoline subsequently pumped therein.

The additive of the above example was tested in several automotive vehicles with the following results:

a. A 1968 one-half ton Ford Pick-up truck with a F 100 engine averaged 9.8 miles per gallon of gasoline prior to the test. After driving the vehicle on 50 gallons of the same gasoline containing the additive, the mileage was increased to 15.4 mpg, under substantially the same operating conditions as prior to the test.

b. A 1969 Pontiac Firebird with a 350 CC engine averaged 11 miles per gallon in city driving prior to the test. After operating on fifty gallons of gasoline containing the additive, the automobile was averaging 16.96 miles per gallon in city driving.

c. A 1972 Chrysler New Yorker having a 440 CC engine averaged 8 miles per gallon prior to the test and 13 miles per gallon after being driven on the same brand of gasoline containing the additive.

Thus improvements of 57%, 54% and 62.5% respectively, in the mileage obtained by the vehicles operating with gasoline containing the additive of this embodiment of the invention were noted. In each test, three ounces of the additive were added to the fuel tank of each car prior to the pumping of twenty gallons of gasoline therein. Then 0.5 ounces of additive was added for each additional ten gallons of gasoline, and a total of fifty gallons of gasoline were utilized in each test. To insure an accurate comparison, the vehicles were driven with the same type of gasoline prior and during the test and the type of driving was also substantially the same.

Having fully described the invention, what is claimed is:

1. A method of making an additive for gasoline which improves the mileage per gallon of said gasoline when used to drive an automotive vehicle therewith comprising the steps of a. immersing about 50 pounds of bituminous coal into a first mixture of about one pound of calcium carbide admixed with about 75 gallons of mineral spirits for a period of about 10 to about 30 hours, b. removing said coal from said mixture and immersing said coal into a second mixture of about one pound of calcium carbide and about 75 gallons of acetone for a period of about 10 to about 30 hours, c. removing said coal from said second mixture and immersing said coal into a third mixture of about one pound of calcium carbide and about 75 gallons of benzene for a period of about 10 to 24 hours, d. combining said first and second mixtures, e. removing said coal from said third mixture, f. combining said third mixture with said first and second mixtures to form a fourth mixture, g. mixing together, by volume, 100 parts of said fourth mixture, about 60 parts of methyl isobutyl ketone, about 300 parts of orthodichlorbenzene, about 370 parts of mineral spirits and about 75 parts tri-o-cresyl phosphate to form a final liquid mixture, h. said final liquid mixture being said additive for gasoline.

2. The method as defined in claim 1 wherein said bituminous coal is first washed and dried prior to immersing it in said mineral spirits - calcium carbide mixture.

3. The method as defined in claim 1 wherein the immersion time for the coal in each of said first, second and third mixtures is about 24 hours.

4. The method as defined in claim 1 wherein said mineral spirits is mineral spirits No. 10.

5. The method as defined in claim 2 wherein said mineral spirits is mineral spirits No. 10.

6. A method of making an additive for gasoline which improves the mileage per gallon of said gasoline when used to drive an automotive vehicle therewith comprising the steps of a. immersing about 50 pounds of bituminous coal into a first mixture of about one pound of a carbide wherein said carbide is selected from the group consisting of alkali metal carbide, alkaline earth metal carbide, aluminum carbide and mixtures thereof, admixed with about 75 gallons of mineral spirits for a period of about 10 to about 30 hours, b. removing said coal from said mixture and immersing said coal into a second mixture of about one pound of carbide and about 75 gallons of dialkyl ketone wherein each alkyl in said dialkyl ketone has from 1 to 12 carbon atoms, for a period of about 10 to about 30 hours, c. removing said coal from said second mixture and immersing said coal into a third mixture of about one pound carbide and about 75 gallons of benzene for a period of about 10 to 24 hours, d. combining said first and second mixtures, e. removing said coal from said third mixture, f. combining said third mixture with said first and second mixtures to form a fourth mixture, g. mixing together, by volume, 100 parts of said fourth mixture, about 60 parts of dialkyl ketone, wherein each alkyl in said dialkyl ketone has from 1 to 12 carbon atoms, about 300 parts of orthodichlorbenzene, about 370 parts of mineral spirits and about 75 parts tri-o-cresyl phosphate to form a final liquid mixture, h. said final liquid mixture being said additive for gasoline.

7. The method as defined in claim 6 wherein each alkyl in said dialkyl ketone has from 1 to 8 carbon atoms.

8. The method as defined in claim 7 wherein said dialkyl ketone is selected from the group consisting of acetone and methyl isobutyl ketone.

9. The additive for gasoline which improves the mileage per gallon of said gasoline when used to operate an automotive vehicle therewith made in accordance with the process defined in claim 1.

10. The gasoline additive made in accordance with the process as defined in claim 6.

11. Gasoline having therein an amount of an additive made in accordance with the process of claim 1 sufficient to increase the miles per gallon of an automotive vehicle using said gasoline as fuel therefor.

12. The gasoline as defined in claim 11 wherein said additive is present in an amount of about 0.1 ounces per gallon of gasoline.

13. Gasoline having therein an amount of additive made in accordance with the process of claim 6 sufficient to increase the miles per gallon of an automotive vehicle using said gasoline as fuel therefor.

14. The gasoline as defined in claim 13 wherein said additive is present in an amount of about 0.1 ounces per gallon of gasoline.

15. An additive for gasoline which improves the mileage per gallon consumed by an automotive vehicle operating thereon, said additive consisting essentially of, in parts per volume, of about 45–75 parts methyl isobutyl ketone, about 270–330 parts orthodichlorbenzene, about 185–740 parts mineral spirits, about 70–130 parts tri-o-cresyl phosphate and about 70–150 parts of toluene.

16. An additive for gasoline which improves the mileage per gallon consumed by an automotive vehicle operating thereon, said additive consisting essentially of, in parts per volume, of about 45–75 parts methyl isobutyl ketone, about 270–330 parts orthodichlorbenzene, about 185–740 parts mineral spirits, about 70–130 parts tri-o-cresyl phosphate and about 70–150 parts of a dialkyl ketone wherein each alkyl has from 1 to about 12 carbon atoms.

17. The additive as defined in claim 1 containing about 60 parts methyl isobutyl ketone, about 300 parts orthodichlorbenzene, about 370 parts of mineral spirits No. 10, about 75 parts tri-o-cresyl phosphate and about 100 parts toluene.

18. Gasoline having therein an amount of the additive defined in claim 15 sufficient to increase the miles per gallon of an automotive vehicle using said gasoline as fuel therefor.

19. The gasoline as defined in claim 18 wherein said additive is present in an amount of from about 0.03 to about 0.07 ounces per gallon of gasoline.

20. The gasoline as defined in claim 19 wherein said additive is present in an amount of about 0.05 ounces per gallon of gasoline.

* * * * *